United States Patent [19]

Melbye

[11] 4,262,462

[45] Apr. 21, 1981

[54] ARRANGEMENT IN ROOFING TILES

[75] Inventor: Arnulf Melbye, Eiksmarka, Norway

[73] Assignee: A/S Norcem, Slemmestad, Norway

[21] Appl. No.: 971,859

[22] Filed: Dec. 21, 1978

[30] Foreign Application Priority Data

Jan. 4, 1978 [NO] Norway ..... 780034

[51] Int. Cl.[3] ..... E04D 1/04; E04D 3/361

[52] U.S. Cl. ..... 52/98; 52/527; 52/537; 52/554; 52/521; 52/105

[58] Field of Search ..... 52/478, 518–523, 52/554, 555, 105, 526, 527, 574, 537, 98–100

[56] References Cited

U.S. PATENT DOCUMENTS

| | | | |
|---|---|---|---|
| 1,491,015 | 4/1924 | McFarland | 52/105 |
| 1,574,098 | 2/1926 | Kridler | 52/554 |
| 1,849,785 | 3/1932 | Black | 52/527 |

FOREIGN PATENT DOCUMENTS

| | | | |
|---|---|---|---|
| 203132 | 9/1923 | United Kingdom | 52/537 |
| 219634 | 10/1924 | United Kingdom | 52/537 |

*Primary Examiner*—James L. Ridgill, Jr.
*Attorney, Agent, or Firm*—Owen, Wickersham & Erickson

[57] ABSTRACT

Two diametrically opposite corners of roofing tiles are cut off to provide cut-outs which are stepped in several steps so as to have at least two edge portions parallel to the side edges of the tile, said edge portions lying closely adjacent matching edge portions of diagonally adjacent tiles of the roofing with a small clearance, whereby the passage or joint formed by the opposed matching edge portions will comprise two parallel non-aligned stretches with a connecting transverse, preferably wider stretch serving as an expansion chamber.

7 Claims, 2 Drawing Figures

ARRANGEMENT IN ROOFING TILES

BACKGROUND OF THE INVENTION

1. Field of the Invention

The present invention relates to an arrangement in substantially rectangular, self-supporting, preferably corrugated roofing tiles to be mounted upon supporting purlins or horizontal laths, each tile being positioned with an overlap with respect to the adjacent tiles both in the horizontal direction and along the line of fall of the roof and being provided with cut-outs at two diagonally opposite corners in order to avoid the need of superimposing the two middle tiles of a crossing formed by four tile corners, while allowing a variation in the overlap distance in the direction of the line of fall of the roof.

2. Description of the Prior Art

When laying roofing tiles or roofing plates with an overlap both in the horizontal direction and in the direction of the line of fall of the roof, joining or overlap crossings occur in the places where the corners of four tiles or plates are superimposed. This is no serious disadvantage when working with thin roofing plates, such as corrugated metal plates, but when the tiles consist of burnt clay, asbestos cement, ceramic material or the like and have a thickness of 4 to 5 mm or more, the situation is different. To enable the two middle corners in the crossing to be situated alongside each other in the same plane instead of being superimposed, it is known to provide two diametrically opposite corners with matching cut-outs, the corner being e.g. simply cut off by an oblique cut.

When roofing with such tiles a first horizontal row of tiles is usually laid at the eaves. Then a second horizontal row of tiles is laid so as to provide a certain overlap with said first layer, etc. until reaching the ridge of the roof, which finally is covered with especial ridge tiles or the like. If the distance between the eaves and the ridge is not a multiple of the pattern height (height of the tile less the overlap distance), the tiles in the top row have to be cut. However, to avoid such cutting it is moreover known (see Austrian Pat. No. 336,851) to alter the overlap distance to such an extent that on any roof not having too small a distance between the eaves and the ridge a roofing using an integer number of tile heights can be obtained. When the tiles are laid with an overlap distance smaller than the maximum possible overlap distance, the tiles having obliquely cut corners will be spaced from each other and thus form a channel or a passage therebetween, up through which precipitation may be pressed under unfavourable wind conditions. According to Austrian Pat. No. 336,851 it is thus known to lengthen each tile somewhat to extend below the lower obliquely cut corner, so that the inlet to this passage is covered to a certain degree. Still a reduced sealing to penetrating precipitation must be expected.

SUMMARY OF THE INVENTION

The object of the present invention is to provide an arrangement in roofing tiles permitting the rate of overlap to vary without reducing the sealing to penetrating precipitation.

According to the invention, this object is achieved by multiple stepping of each cut-out so as to have at least two edge portions which are parallel to the side edges of the tile and with a small clearance match corresponding edge portions of diagonally adjacent tiles. Preferably, the edge portions of the cut-outs parallel to the side edges are connected by edge portions extending perpendicularly to the side edges. In this manner it is achieved that the passage or channel formed between the edges of the two middle, diagonally adjacent tiles will extend along a heavily broken line and include a plurality of very narrow stretches with intermediate wider stretches serving as expansion chambers. If precipitation should be pressed in through the first narrow stretch of the passage or channel due to wind pressure, the air being pressed in will expand in the subsequent expansion chamber, resulting in a turbulence with destruction of the kinetic energy, so that water will not penetrate further into said passage, but drain out beneath the lower of the two middle tiles. Of the matching edge portions having a small clearance the one lying innermost in the channel formed by the opposed edges of the cut-outs should be situated approximately along the wave crest nearest to the side edge. Water penetrating into said channel or passage then has to be pressed all the way up to a wave crest in order to find its way past the roofing.

According to a further feature of the invention, to allow the tiles to be placed with a varying overlap distance in the height direction without necessitating the drilling of larger holes in any of the tiles than what is required for passing the attachment nails through the tiles and into the horizontal laths, weakened portions in the form of elongated grooves or rows of recesses are formed on the underside of one or more of the wave crests near the upper edge of the tile, said grooves or rows having a length such that nail holes near the lower edge of the next overlying tile will always be situated above a weakened portion when the tiles have an overlap distance within the prescribed range.

The invention will now be described in further detail with reference to an exemplary embodiment shown in the drawing.

DESCRIPTION OF THE PREFERRED EMBODIMENT

Figure 1:
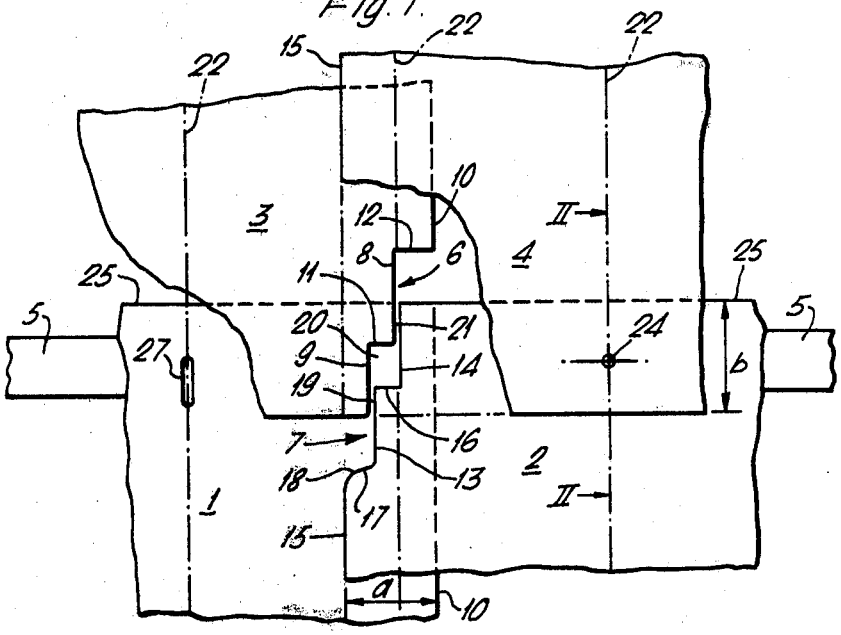
FIG. 1 is a view of a crossing formed by four tiles, the corner of the uppermost tile being cut away to expose the two middle tiles.
Figure 2:
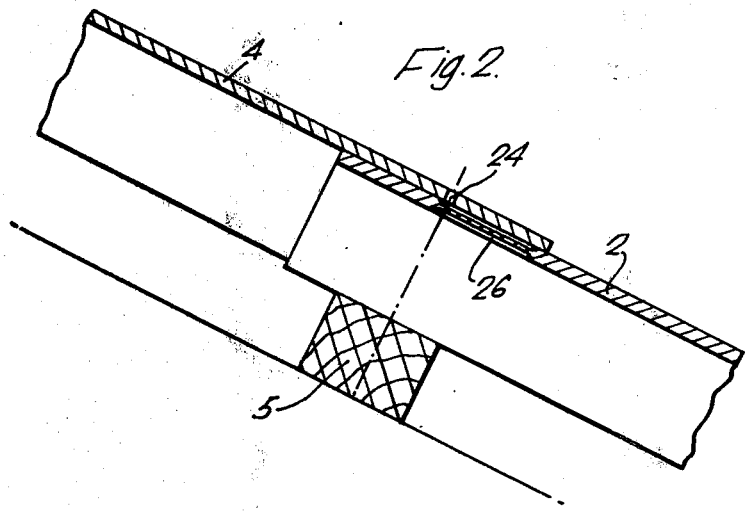
FIG. 2 is a sectional view taken along the line II—II in FIG. 1.

In FIG. 1 there are illustrated fragments of four like roofing tiles 1, 2, 3 and 4 being arranged with an overlap both laterally (horizontally) and lengthwise (the direction of the line of fall of the roof). Under each lengthwise overlap area horizontal laths 5 are arranged to which the roofing tiles are nailed down.

The tiles 1 and 4 shown in the drawing are generally laid in the order of their reference numerals so that the tile 1 will be situated on the bottom and the tile 4 on the top. The tiles 2 and 3 would also be situated one partly above the other were it not for the fact that the tiles are provided with stepped cut-outs 6 and 7 in their lower right and their upper left corners. When laying each horizontal row of tiles from the right to the left instead of from the left to the right, the lower left and the upper right corners will have to be the ones provided with cut-outs. Each cut-out is stepped in several steps, and the cut-out 6 is defined by two edge portions 8 and 9 which are parallel to the side edges 10 and 15 of the tile. Further edge portions 11 and 12 which are substantially perpendicular to the side edge 10, extend between the two edge portions 8 and 9 and between the edge portion 8 and the side edge 10, respectively. The cut-out 7 has a generally matching shape being defined by edge portions 13 and 14 which are parallel to the side edges 10 and 15 of the tile. The edge portions 13 and 14 and the edge portion 13 and the side edge 15, respectively, are connected by edge portions 16 and 17 extending perpendicularly to the side edge 15, and the corner between the edge portion 17 and the side edge 15 may be well rounded as shown at 18. The tiles 1 and 2 are laid with a certain lateral overlap a. This overlap is constant and may e.g. be defined by the fact that the tiles are corrugated with crest lines extending lengthwise. When the plate crossing shown in the drawing has been laid, the tiles will have a laterally fixed mutual position because the waves engage each other, and the edge portions 9, 13 and 8, 14, respectively, will then be parallel having a small clearance in the lateral direction. The channel between the tiles 2 and 3 will therefore consist of a narrow passage 19, a wider expansion chamber 20 and a further narrow passage 21. The crest lines of the corrugated tiles are indicated at 22, and it will be seen that the stretch 21 of the channel is situated approximately in the crest line 22.

As apparent from FIG. 1 the overlap distance b in the direction of the height of the roof may be varied. One full corrugation 28 of a tile occurs between adjacent wave crests 22 as indicated. The largest overlap distance is obtained when the edge portions 11 and 16 connecting the edge portions of the cut-outs which are parallel to the side edges of the tile, abut each other. The smallest overlap distance b is shown in FIG. 1. As will be seen narrow passages 19 and 21 of considerable length are obtained even with the smallest overlap distance. The reduction of the expansion chamber 20 due to the increase of the overlap distance is compensated by an increased length of the stretches 19 and 21 and by the increased overlap distance.

At the lower edge 23 of the tiles there are holes 24 in one or more of the wave crests for nailing the tile. Corresponding holes at the upper edge of the tile 25 would have to be oblong to permit the desired variation in the overlap distance. Such large holes will, however, impair the tightness of the roof, and instead weakened portions in the form of oblong grooves 26 are formed on the underside of the tile. When a nail is driven in through a hole 24, it will hit the weakened portion of the subjacent tile, but will merely make a hole therein corresponding to the thickness of the nail. The embodiment shown having weakened portions instead of throughgoing holes moreover has the advantage that the tile can remain tight in places where the tile shall not be nailed at the upper edge (e.g. at the upper end of a pent roof).

Immediately above the weakening grooves 26 formed on the underside of the tile, markings may be formed on the top side of the tile, e.g. in the form of shallow countersinks 27 which serve to guide the nail towards the weakened portions.

The design of the weakening grooves 26 as well as the design of the cut-outs 6 and 7 are related to the possibility of obtaining a varying overlap distance without impairing the sealing to penetrating precipitation.

The grooves 26 may also be replaced by rows of recesses.

What I claim is:

1. An improvement in roofing comprising generally rectangular, self-supporting, corrugated roofing tiles or panels mounted in horizontal rows or courses on supporting purlins, each tile being positioned with the wave crests of the corrugations extending parallel to the line of fall of the roof and with a lateral overlap with respect to the adjacent tile or tiles in the row to form lateral overlap areas, said lateral overlap areas being aligned with the lateral overlap areas of the other rows, each row being positioned with a horizontal overlap with respect to the adjacent row or rows to form horizontal overlap areas, said lateral and horizontal overlap areas forming crossings where the corners of four tiles meet, at least some of the tiles being provided with mating cut-puts at two diagonally opposite corners so that the two middle, diagonally adjoining tiles of each crossing are positioned edgewise in non-overlapping position, the edges of the mating cut-outs forming a channel therebetween, the shape of the tiles including the cut-outs allowing a variation of the horizontal overlap, said improvement comprising that each cut-out is defined by at least two first edge portions which are parallel to the wave crests and second edge portions connecting said first edge portions with each other and with the side edge of the tile and extending transversely to the wave crests, the adjacent first edge portions of adjacent tiles forming narrow passages in said channel separated by a wider channel portion defined between said second edge portions and serving as an expansion chamber, whereby the horizontal overlap of the rows may be increased without adversely affecting the sealing produced by the roofing.

2. Roofing according to claim 1, wherein the highest of said narrow passages at each crossing is situated approximately along a wave crest.

3. Roofing according to claim 1, wherein a hole for nailing the tile is provided near the lower edge of each tile on at least one wave crest, and wherein at least one weakened portion is formed along the underside of said wave crest near the upper edge of said tile, said weakened portion having a length sufficient to ensure that said hole in the next overlying tile will be situated over a part of said weakened portion irrespective of the horizontal overlap.

4. Roofing according to claim 3, wherein a shallow depression is provided on the top side of the tile opposite each weakened portion to provide a guiding for a nail inserted through the hole in the next overlying tile.

5. A roofing tile for installation in horizontal rows on supporting purlins serially on a pitched roof, and for permitting adjustment in the degree of horizontal overlap between adjacent rows so that cutting of tiles in the uppermost row is avoided, said tile being generally rectangular and being currugated with wave crests and troughs arranged to be parallel to the line of fall of the roof, and said tile having cut-outs at two diagonally opposite corners for mating with similar cut-outs in adjacent tiles so that upon installation, at a crossing where four tiles meet, the two middle, diagonally adjoining tiles are positioned edgewise in non-overlapping position, said cut-outs each comprising at least two steps, with at least two first edge portions substantially parallel to the wave crests, one extending in from the horizontal edge of the tile, and second edge portions connecting the first edge portions with each other and with the side edge of the tile and extending substantially transversely of the wave crests, the outermost second edge portion at one corner of the tile being substantially the same length as the outermost second edge portion at the diagonally opposite corner of the tile so that upon installation the adjacent first edge portions of adjacent tiles form at least two narrow passages separated by a wider channel portion defined between second edge portions of the two tiles, for providing effective water sealing regardless of the extent of horizontal overlap.

6. The roofing tile of claim 5, wherein a hole for nailing the tile is provided near the lower edge of the tile on at least one wave crest, and wherein at least one weakened portion is formed along the underside of said wave crest near the upper edge of said tile, said weakened portion having a length sufficient to ensure that said hole in the next overlying tile will be situated over a part of said weakened portion irrespective of the horizontal overlap.

7. The roofing tile of claim 6, wherein a shallow depression is provided on the top side of the tile opposite each weakened portion to provide a guiding for a nail inserted through the hole in the next overlying tile.

* * * * *